US010436196B2

(12) United States Patent
Vaidya

(10) Patent No.: US 10,436,196 B2
(45) Date of Patent: Oct. 8, 2019

(54) SCREW ROTOR WITH HIGH LOBE COUNT

(71) Applicant: Carrier Corporation, Jupiter, FL (US)

(72) Inventor: Amit Vaidya, Jamesville, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 173 days.

(21) Appl. No.: 15/315,551

(22) PCT Filed: Jun. 1, 2015

(86) PCT No.: PCT/US2015/033526
§ 371 (c)(1),
(2) Date: Dec. 1, 2016

(87) PCT Pub. No.: WO2015/187553
PCT Pub. Date: Dec. 10, 2015

(65) Prior Publication Data

US 2017/0122318 A1 May 4, 2017

Related U.S. Application Data

(60) Provisional application No. 62/006,487, filed on Jun. 2, 2014.

(51) Int. Cl.
*F04C 18/16* (2006.01)
*F04C 23/00* (2006.01)
*F04C 18/08* (2006.01)

(52) U.S. Cl.
CPC ..... *F04C 18/16* (2013.01); *F04C 18/084* (2013.01); *F04C 23/008* (2013.01)

(58) Field of Classification Search
CPC ..... F04C 18/084; F04C 18/16
See application file for complete search history.

(56) References Cited

U.S. PATENT DOCUMENTS 3,986,801 A 10/1976 Garland
4,062,199 A * 12/1977 Kasahara ..... F04C 29/0007 418/15

(Continued)

FOREIGN PATENT DOCUMENTS

CN 101846075 A 9/2010
CN 101910750 A 12/2010

(Continued)

OTHER PUBLICATIONS

International Search Report and Written Opinion for PCT/US2015/033526, dated Aug. 10, 2015.

(Continued)

*Primary Examiner* — Mary Davis
(74) *Attorney, Agent, or Firm* — Bachman & LaPointe, P.C.

(57) ABSTRACT

A compressor (22) comprises a housing (50) having a first port (26) and a second port (28). A male rotor (52) has a working portion (64) having a plurality of lobes (110) of a count ($N_M$) and at least a first shaft portion (62) protruding beyond a first end (68) of the male rotor working portion and mounted for rotation about a first axis (500). A female rotor (54) has a working portion (66) having a plurality of lobes (112) of a count ($N_F$) and mounted for rotation about a second axis (502) so as to be enmeshed with the male rotor working portion. An electric motor (56) is within the housing and has a stator (58) and a rotor (60) mounted to the first shaft portion. The compressor has no additional compressor rotors. The lobe count of the male rotor is less than the lobe count of the female rotor. A combined lobe count ($N_M$+$N_F$) is at least fifteen.

16 Claims, 2 Drawing Sheets

(56) References Cited

U.S. PATENT DOCUMENTS

| | | | | |
|---|---|---|---|---|
| 4,643,654 | A | 2/1987 | Rinder | |
| 5,108,275 | A | 4/1992 | Sager | |
| 5,548,973 | A | 8/1996 | Komine et al. | |
| 5,642,992 | A | 7/1997 | Shaw | |
| 6,003,324 | A | 12/1999 | Shaw | |
| 6,296,461 | B1 | 10/2001 | Stosic | |
| 7,163,387 | B2 | 1/2007 | Tang | |
| 7,802,974 | B2 | 9/2010 | Rockwell et al. | |
| 7,980,836 | B2 | 7/2011 | Shaw | |
| 9,032,750 | B2 * | 5/2015 | Nemit, Jr. | F04C 18/16 62/228.1 |
| 2006/0039805 | A1 * | 2/2006 | Gotou | F04C 28/08 417/410.4 |
| 2007/0137610 | A1 | 6/2007 | Hudson | |
| 2008/0107552 | A1 * | 5/2008 | Fujii | F04C 2/126 417/423.12 |
| 2010/0247366 | A1 | 9/2010 | Kato et al. | |
| 2010/0281894 | A1 | 11/2010 | Huff | |
| 2011/0271699 | A1 | 11/2011 | Lee | |
| 2012/0171069 | A1 | 7/2012 | Huang et al. | |
| 2012/0328464 | A1 | 12/2012 | Fujiki et al. | |
| 2013/0091892 | A1 * | 4/2013 | Nemit, Jr. | F04C 18/16 62/498 |
| 2013/0108495 | A1 | 5/2013 | Bakkestuen et al. | |
| 2016/0208801 | A1 * | 7/2016 | Hauser | F04C 18/16 |

FOREIGN PATENT DOCUMENTS

| | | | |
|---|---|---|---|
| CN | 102352840 | A | 2/2012 |
| CN | 202971199 | U | 6/2013 |
| CN | 102287374 | B | 10/2013 |
| CN | 103603805 | A | 2/2014 |
| DE | 1936275 | A1 | 1/1971 |
| DE | 10258145 | A1 | 6/2004 |
| JP | 2007085256 | A | 4/2007 |
| WO | 2013/067099 | A1 | 5/2013 |

OTHER PUBLICATIONS

Chinese Office action dated Apr. 2, 2018 for Chinese Patent Application No. 201580021068.0.

* cited by examiner

SCREW ROTOR WITH HIGH LOBE COUNT

CROSS-REFERENCE TO RELATED APPLICATION

Benefit is claimed of U.S. Patent Application Ser. No. 62/006,487, filed Jun. 2, 2014, and entitled "Screw Compressor", the disclosure of which is incorporated by reference herein in its entirety as if set forth at length.

BACKGROUND

The disclosure relates to screw compressors. More particularly, the disclosure relates to twin-rotor hermetic or semi-hermetic compressors.

U.S. Pat. No. 7,163,387 (the '387 patent) discloses a twin-rotor compressor rotor lobe geometry. The illustrated compressor has a five-lobed male rotor and a six-lobed female rotor. Other known asymmetric twin rotor compressors have a five-lobed male rotor and a seven-lobed female rotor or six-lobed male rotor and a seven-lobed female rotor.

SUMMARY

One aspect of the disclosure involves a compressor comprising a housing having a first port and a second port. A male rotor has a working portion having a plurality of lobes of a count ($N_M$) and at least a first shaft portion protruding beyond a first end of the male rotor working portion and mounted for rotation about a first axis. A female rotor has a working portion having a plurality of lobes of a count ($N_F$) and mounted for rotation about a second axis so as to be enmeshed with the male rotor working portion. An electric motor is within the housing and has a stator and a rotor mounted to the first shaft portion. The lobe count of the male rotor is less than the lobe count of the female rotor. A combined lobe count ($N_M$+$N_F$) is at least fifteen.

In one or more embodiments of any of the foregoing embodiments, the compressor has no additional compressor rotors.

In one or more embodiments of any of the foregoing embodiments, the combined lobe count ($N_M$+$N_F$) is fifteen to twenty-one.

In one or more embodiments of any of the foregoing embodiments, the lobe count ($N_M$) of the male rotor and the lobe count ($N_F$) of the female rotor are no more than one different from each other.

In one or more embodiments of any of the foregoing embodiments, the lobe count ($N_M$) of the male rotor is one less than the lobe count ($N_F$) of the female rotor.

In one or more embodiments of any of the foregoing embodiments, one of: the lobe count of the male rotor is seven and the lobe count of the female rotor is eight; the lobe count of the male rotor is eight and the lobe count of the female rotor is nine; the lobe count of the male rotor is nine and the lobe count of the female rotor is ten; and the lobe count of the male rotor is ten and the lobe count of the female rotor is eleven.

In one or more embodiments of any of the foregoing embodiments, one or both of a tip-to-root ratio of the lobes of the female rotor is no more than 1.50:1 and a tip-to-root ratio of the lobes of the male rotor is no more than 1.42:1.

In one or more embodiments of any of the foregoing embodiments, one or both of the tip-to-root ratio of the lobes of the female rotor is 1.30:1 to 1.50:1 and the tip-to-root ratio of the lobes of the male rotor is 1.36:1 to 1.42:1.

In one or more embodiments of any of the foregoing embodiments, the lobe count of the male rotor is seven and the lobe count of the female rotor is eight, the tip-to-root ratio of the lobes of the female rotor is 1.49:1 to 1.50:1, and the tip-to-root ratio of the lobes of the male rotor is 1.41:1 to 1.42:1.

In one or more embodiments of any of the foregoing embodiments, a full-load volume index is 1.7-4.0.

In one or more embodiments of any of the foregoing embodiments, the first shaft portion is cantilevered from a bearing between the first shaft portion and the male rotor working portion.

In one or more embodiments of any of the foregoing embodiments, a method for using the compressor comprises running the compressor at a speed of at least 90 Hz.

In one or more embodiments of any of the foregoing embodiments: the running of the compressor compresses refrigerant; the compressed refrigerant is passed to a heat rejection heat exchanger to cool; the cooled refrigerant is passed to an expansion device to expand and further cool; the expanded and further cooled refrigerant is passed to a heat absorption heat exchanger to absorb heat and warm; and the warmed refrigerant is passed back to the compressor.

In one or more embodiments of any of the foregoing embodiments, the running of the compressor comprises operating at a full load volume index of 1.7-4.0 and, optionally, unloading.

In one or more embodiments of any of the foregoing embodiments, a vapor compression system comprises: the compressor; a heat rejection heat exchanger; an expansion device; a heat absorption heat exchanger; and a refrigerant flowpath passing sequentially through the compressor, the heat rejection heat exchanger, the expansion device and the heat absorption heat exchanger and returning to the compressor.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 2:
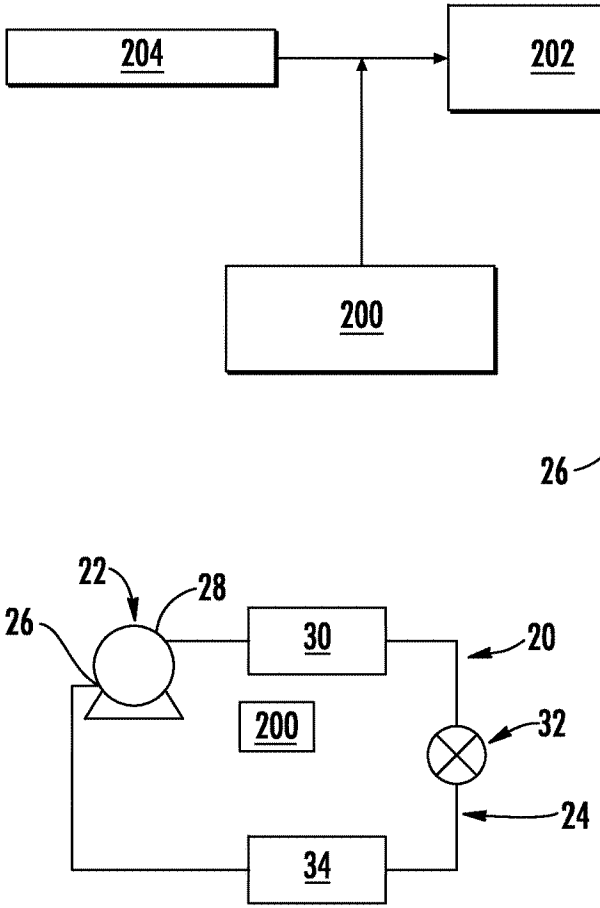
FIG.2 (PRIOR ART)
FIG. 2 is a schematic view of a vapor compression system.

FIG. 2 shows a vapor compression system 20 having a compressor 22 along a recirculating refrigeration flowpath 24. The exemplary system 20 is a most basic system for purposes of illustration. Many variations are known or may yet be developed. Along the flowpath 20, the compressor 22 has a suction port (inlet) 26 and a discharge port (outlet) 28. In a normal operational mode, refrigerant drawn in via the suction port 26 is compressed and discharged at high pressure from the discharge port 28 to proceed downstream along the flowpath 24 and eventually return to the suction port. Sequentially from upstream to downstream along the flowpath 24 are: a heat exchanger 30 (in the normal mode a heat rejection heat exchanger); an expansion device 32 (e.g., an electronic expansion valve (EXV) or a thermal expansion valve (TXV)); and a heat exchanger 34 (in the normal mode a heat absorption heat exchanger). The exchangers may, according to the particular task involved, be refrigerant-air heat exchangers, refrigerant-water heat exchangers, or other variants.

Figure 1:
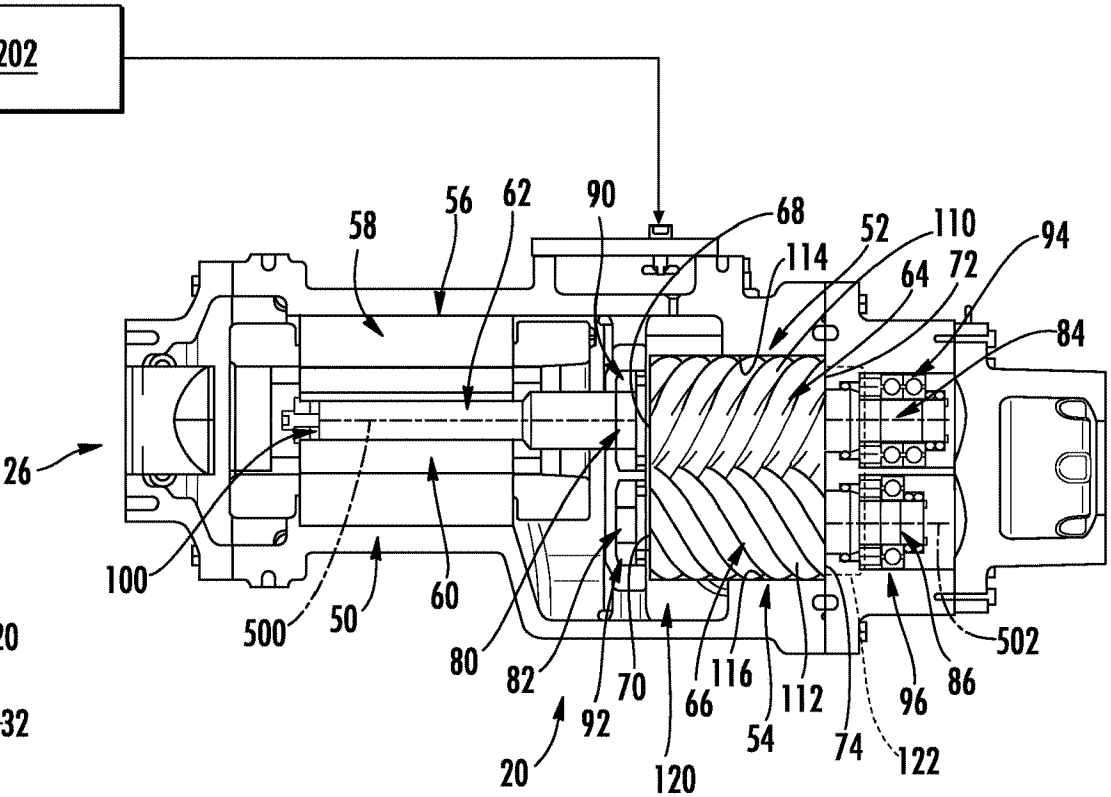
FIG. 1 is an axial cutaway view of a twin-rotor screw compressor.

FIG. 1 shows the compressor 20 as a positive displacement compressor, namely twin-rotor screw compressor having a housing assembly (housing) 50. The compressor has a pair of rotors 52, 54 discussed in further detail below. The exemplary compressor is a semi-hermetic compressor wherein an electric motor 56 is within the housing assembly and exposed to the refrigerant flowing between the suction port 26 and discharge port 28. The exemplary motor comprises a stator 58 fixedly mounted within the housing and a rotor 60 mounted to a shaft portion 62 of the first rotor 52.

Each of the rotors 52, 54 has a lobed working portion or section 64, 66 extending from a first end 68, 70 to a second end 72, 74. The rotors include shaft portions 80, 82 protruding from the first ends and 84, 86 protruding from the second ends. The shaft portions may be mounted to bearings 90, 92, 94, and 96. The bearings support the respective rotors for rotation about respective axes 500, 502 (FIG. 3) parallel to each other. The exemplary shaft portion 62 is located distally of the shaft portion 80 and extends to an end 100. The exemplary shaft portion 62 lacks any additional bearing support so that the motor rotor 60 is held cantilevered from the bearing 90.

The respective rotor working portions 64, 66 have lobes 110, 112 enmeshed with each other. The rotor lobes combine with housing bores 114, 116 receiving the respective rotors to form compression pockets. In operation, the compression pockets sequentially open and close at a suction plenum 120 and at a discharge plenum 122. This opening/closing action serves to draw fluid in through the inlet 26, then to the suction plenum, then compress the fluid and discharge it into the discharge plenum, to in turn pass to the outlet. The fluid drawn in through the suction port 26 may pass through/around the motor so as to cool the motor before reaching the suction plenum.

In operation, the motor directly drives the male rotor. The interaction with the male rotor lobes with the female rotor lobes, in turn, drives rotation of the female rotor. For an exemplary air-cooled compressor with R134A refrigerant, exemplary basic full-load compressor volume index is 3.35 or 2.7, more broadly, 1.7 to 4.0 or 2.0 to 4.0 or 2.5 to 3.5. For a variable capacity compressor, one or more unloading and/or volume index (VI) valves may be used to reduce compression below such basic full-load values. The exemplary motor is an induction motor. An exemplary induction motor is a two-pole motor.

The opening of the compression pockets at the discharge plenum produces a pulsation. The cantilevered nature of the rotor/stator makes it particularly sensitive to sympathetic vibration induced by the discharge pulsation. This can limit the frequency range (speed) of the motor. To mitigate such effects, a unique lobe configuration is proposed and disclosed in FIG. 3. In this configuration, the male rotor 52 is rotated in a direction 510 about its axis 500 to, in turn, drive the female rotor 54 in an opposite direction 512 about its axis 502. Relative to the aforementioned embodiment of the '387 patent, this illustrated configuration has seven lobes 110 on the male rotor and eight lobes 112 on the female rotor.

Figure 3:
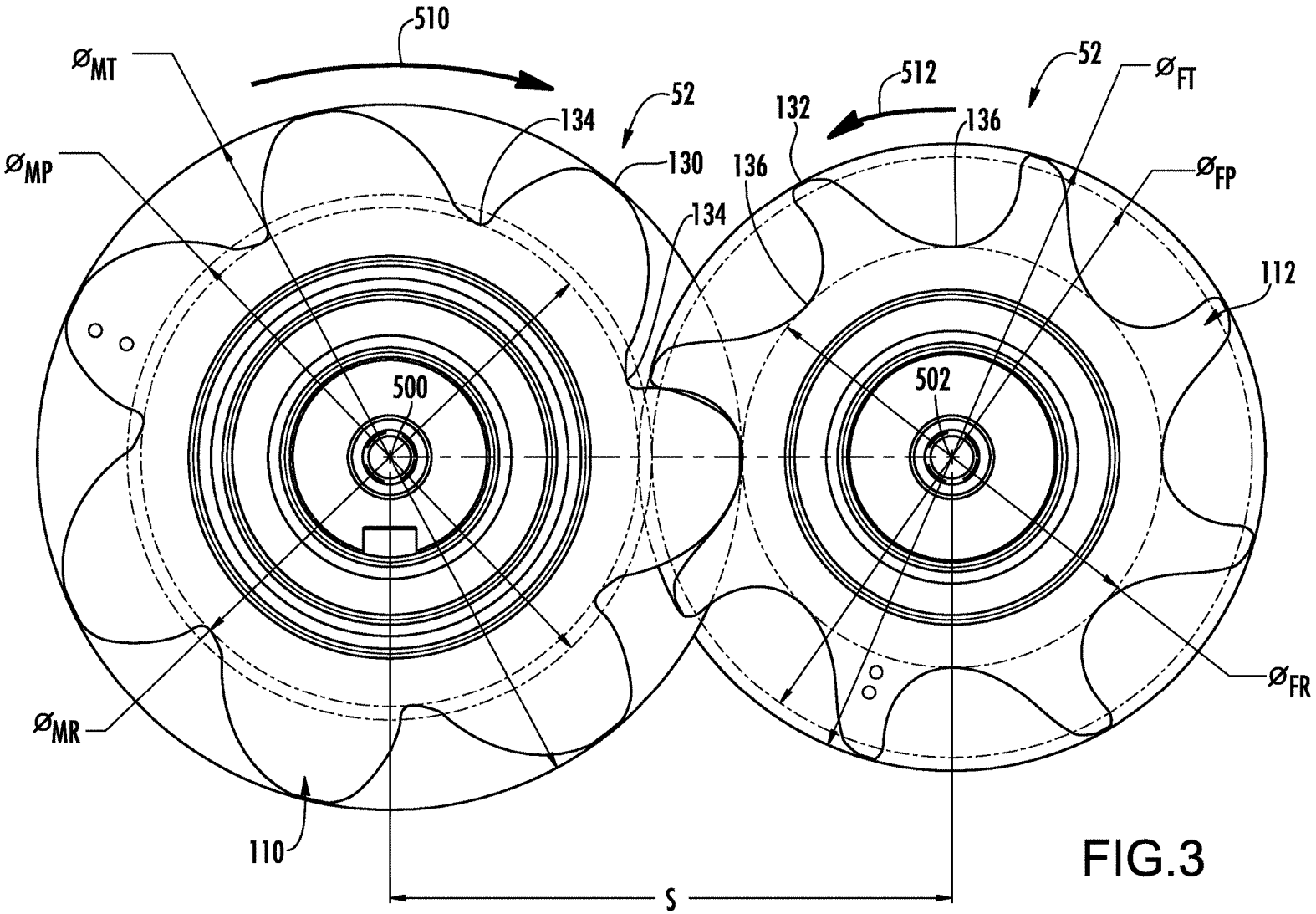
FIG. 3 is an isolated inlet end view of rotors of the compressor of FIG. 1.

Each of the respective male and female lobes has a tip 130, 132 and a root 134, 136. FIG. 3 shows tip diameters $Ø_{MT}$ and $Ø_{FT}$ and root diameters $Ø_{MR}$ and $Ø_{FR}$. FIG. 3 further shows an inter-axis spacing S. FIG. 3 also shows pitch diameters $Ø_{MP}$ and $Ø_{FP}$. These are defined as an imaginary diameter where pure rolling occurs.

Example 1

In one example of rotor dimensions, dimensions are as follows:

TABLE I

| Rotor Dimensions | | | | |
|---|---|---|---|---|
| Dimension | Example 1 | Prior Art 1 | Prior Art 2 | Prior Art 3 |
| Male Lobes | 7 | 5 | 5 | 5 |
| Female lobes | 8 | 7 | 6 | 6 |
| $Ø_{MT}$ | 167.771 | | | |
| $Ø_{MR}$ | 118.562 | | | |
| $Ø_{MT}/Ø_{MR}$ | 1.415 | 1.589 | 1.626 | 1.451 |
| $Ø_{MP}$ | 124.936 | | | |
| $Ø_{FT}$ | 149.158 | | | |
| $Ø_{FR}$ | 99.949 | | | |
| $Ø_{FT}/Ø_{FR}$ | 1.492 | 1.755 | 1.800 | 1.612 |
| $Ø_{FP}$ | 142.784 | | | |
| S | 133.86 | | | |

In the exemplary rotor, the tip to root ratio of the male rotor is 1.415 and that of the female rotor is 1.492. Compared to a hypothetical baseline compressor having a five-lobed male rotor and six-lobed female rotor, the exemplary increase of two lobes per rotor may have one or more of several advantages. First, this may be used to reduce the amount of refrigerant compressed in each compression pocket. Thereby, the mass flow per discharge pulse is decreased and the magnitude of the discharge pulse is decreased. This may reduce sound and stimulus for vibration of other system components.

Second, the relatively low tip-to root ratio may alter the resonance characteristics of the rotors. The shallower lobes may increase the rotor dynamic limit. More particularly, the rotor may be relatively stiff and may increase resonance frequencies. At a given tip diameter, lower tip-to-root ratio means a greater root diameter and a stiffer lobed working portion of the rotor. Even if the diameters of the bearing-engaging shaft portions 80, 84; 82, 86 protruding from the working portion 64; 66 remain unchanged (relative to a baseline), the increased stiffness of the working portion increases overall stiffness. This is particularly relevant to the male rotor where the motor stator is cantilevered on the rotor shaft portion 62. Resonance excursions of the motor rotor and shaft portion 62 may damage the compressor. One solution presenting additional complexities would be to add a bearing at the end of the shaft portion 62.

This may also allow an increase in compressor speed. For example, the baseline compressor may be kept below 90 Hz in order to limit sound and/or limit vibration of the motor rotor. The higher lobe count may allow higher speed operation due to both mechanisms mentioned above. Exemplary speed is 90 Hz to 150 Hz, more particularly, exemplary values are 90 Hz to 120 Hz or 95 Hz to 120 Hz or 95 Hz to 110 Hz or 100 Hz to 120 Hz.

More broadly, exemplary male rotor tip to root ratio is no more than 1.44:1, 1.43:1, or 1.42:1 and exemplary female rotor tip to root ratio is no more than 1.55:1 or 1.50:1. Both of these may be at least 1.1:1 or 1.2:1. More specifically, exemplary male rotor tip to ratio is 1.36:1 to 1.42:1 or 1.41:1 to 1.42:1 and exemplary female rotor tip to ratio is 1.30:1 to 1.50:1 or 1.49:1 to 1.50:1.

More broadly, exemplary combined lobe count is fifteen to twenty-one or fifteen to eighteen. This provides the vibration benefits while maintaining sufficient capacity.

FIG. 1 further shows a controller 200. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components. In this example, the controller 200 may control the motor via a variable frequency drive 202 which draws power from a source 204. An exemplary source 204 is two-phase or three-phase commercial AC wall power as may be available in particular regions of the world. Examples include 240V/60 Hz, 460/60, 400/50, 380/50, 575/60, and the like.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A compressor (22) comprising:
a housing (50) having a first port (26) and a second port (28);
a male rotor (52) having:
a working portion (64) having a plurality of lobes (110) of a count ($N_M$); and
at least a first shaft portion (62) protruding beyond a first end (68) of the male rotor working portion and mounted for rotation about a first axis (500);
a female rotor (54) having:
a working portion (66) having a plurality of lobes (112) of a count ($N_F$) and mounted for rotation about a second axis (502) so as to be enmeshed with the male rotor working portion; and
an electric motor (56) within the housing and having:
a stator (58); and
a motor rotor (60) mounted to the first shaft portion,
wherein:
one or both of:
a tip-to-root ratio of the lobes of the female rotor is no more than 1.50:1; and
a tip-to-root ratio of the lobes of the male rotor is no more than 1.42:1;
the lobe count of the male rotor is less than the lobe count of the female rotor; and
a combined lobe count ($N_M$+$N_F$) is at least fifteen.

2. The compressor of claim 1 wherein:
the compressor has no additional compressor rotors.

3. The compressor of claim 1 wherein:
the combined lobe count ($N_M$+$N_F$) is fifteen to twenty-one.

4. The compressor of claim 1 wherein:
the lobe count ($N_M$) of the male rotor and the lobe count ($N_F$) of the female rotor are no more than one different from each other.

5. The compressor of claim 1 wherein:
the lobe count ($N_M$) of the male rotor is one less than the lobe count ($N_F$) of the female rotor.

6. The compressor of claim 1 wherein one of:
the lobe count of the male rotor is seven and the lobe count of the female rotor is eight;
the lobe count of the male rotor is eight and the lobe count of the female rotor is nine;
the lobe count of the male rotor is nine and the lobe count of the female rotor is ten; and
the lobe count of the male rotor is ten and the lobe count of the female rotor is eleven.

7. The compressor of claim 1 wherein:
the tip-to-root ratio of the lobes of the female rotor is no more than 1.50:1; and
the tip-to-root ratio of the lobes of the male rotor is no more than 1.42:1.

8. The compressor of claim 7 wherein one or both of:
the tip-to-root ratio of the lobes of the female rotor is 1.30:1 to 1.50:1; and
the tip-to-root ratio of the lobes of the male rotor is 1.36:1 to 1.42:1.

9. The compressor of claim 7 wherein:
the tip-to-root ratio of the lobes of the female rotor is 1.30:1 to 1.50:1; and
the tip-to-root ratio of the lobes of the male rotor is 1.36:1 to 1.42:1.

10. The compressor of claim 7 wherein:
the lobe count of the male rotor is seven and the lobe count of the female rotor is eight;
the tip-to-root ratio of the lobes of the female rotor is 1.49:1 to 1.50:1; and
the tip-to-root ratio of the lobes of the male rotor is 1.41:1 to 1.42:1.

11. The compressor of claim 1 wherein:
a full-load volume index is 1.7-4.0.

12. The compressor of claim 1 wherein:
the first shaft portion (62) is cantilevered from a bearing (90) between the first shaft portion and the male rotor working portion (64).

13. A method for using the compressor of claim 1, the method comprising:
running the compressor at a speed of at least 90 Hz.

14. The method of claim 13 wherein:
the running of the compressor compresses refrigerant;
the compressed refrigerant is passed to a heat rejection heat exchanger to cool the refrigerant;
the cooled refrigerant is passed to an expansion device to expand and further cool the cooled refrigerant;
the expanded and further cooled refrigerant is passed to a heat absorption heat exchanger to absorb heat and warm the expanded and further cooled refrigerant; and
the warmed refrigerant is passed back to the compressor.

15. The method of claim 13 wherein:

the running of the compressor comprises operating at volume index of 1.7-4.0.

16. A vapor compression system (20) comprising:

the compressor (22) of claim 1;

a heat rejection heat exchanger (30);

an expansion device (32);

a heat absorption heat exchanger (34); and a refrigerant flowpath (24) passing sequentially through the compressor, the heat rejection heat exchanger, the expansion device and the heat absorption heat exchanger and returning to the compressor.

* * * * *